United States Patent [19]

Connor et al.

[11] Patent Number: 4,633,975

[45] Date of Patent: Jan. 6, 1987

[54] UNDER-BRIDGE ACCESS ASSEMBLY

[75] Inventors: Richard C. Connor, New Milton; Dennis A. Rule, Bournemouth, both of England

[73] Assignee: The Secretary of State for Defence in Her Britannic Majesty's Government of the United Kingdom of Great Britain and Northern Ireland, London, England

[21] Appl. No.: 711,493

[22] Filed: Mar. 14, 1985

[30] Foreign Application Priority Data

Mar. 19, 1984 [GB] United Kingdom ..... 8407141

[51] Int. Cl.[4] ..... B66F 11/04

[52] U.S. Cl. ..... 182/63; 182/143

[58] Field of Search ..... 182/62.5–67, 182/141, 142, 145, 148, 36, 37, 2

[56] References Cited

U.S. PATENT DOCUMENTS

| | | | |
|---|---|---|---|
| 2,598,730 | 6/1952 | Thompson | 182/145 |
| 3,145,801 | 8/1964 | Callahan | 182/63 |
| 3,197,178 | 7/1965 | Nietz | 182/63 |
| 3,608,669 | 9/1971 | Lindsay | 182/148 |
| 3,900,080 | 8/1975 | Rea | 182/36 |
| 3,995,250 | 11/1976 | Ferree | 248/316.1 |
| 4,044,858 | 8/1977 | Vikre | 182/150 |
| 4,154,318 | 5/1979 | Malleone | 182/19 |

FOREIGN PATENT DOCUMENTS

| | | | |
|---|---|---|---|
| 1036511 | 8/1978 | Canada | 182/2 |

*Primary Examiner*—Reinaldo P. Machado
*Assistant Examiner*—Alvin Chin-Shue
*Attorney, Agent, or Firm*—William R. Hinds

[57] ABSTRACT

Apparatus and method for providing access to the underside of a bridge deck. A tower is supported vertically beside a bridge deck by means of a launch frame mounted on a stabilized support pillar; the tower in turn supporting a platform horizontally beneath the bridge-deck by means of a centilever frame. The apparatus is made quickly deployable by providing that the tower is engageable with the launch frame so as to allow it to be launched over the parapet of the bridge-deck while being supported in a substantially horizontal position with the platform supported substantially vertically to the tower, and to be rotatable into a substantially vertical portion adjacent the bridge deck to bring the platform into position underneath the bridge-deck. Access is gained to the underside of the bridge deck by climbing down the tower and onto and along the platform.

5 Claims, 6 Drawing Figures

UNDER-BRIDGE ACCESS ASSEMBLY

TECHNICAL FIELD

This invention relates to apparatus and methods for providing access to the underside of a bridge deck.

BACKGROUND ART

A principal method of demolishing a bridge is to fix a charge securing system to the underside of the deck of the bridge to which demolition charges can be attached for subsequent detonation. It is necessary for personnel to gain access to the underside of the bridge deck in order to place these demolition components. Several methods of providing the required access are known. Some rely on gaining access from the grounds beneath the bridge, for example by ladders or vehicles with elevatable platforms, but these are not usable if the bridge is too high or spans inaccessible ground or a waterway for example. In such cases an alternative method that has been adopted, which has the advantage of being usable with most bridge designs, is to build a scaffold structuure on the bridge deck to support a platform beneath it. The main disadvantage of this system, however, is that it involves a lengthy construction process which is not suited to operations where speedy deployment is of great importance.

DISCOSURE OF INVENTION

It is an object of the present invention to provide an apparatus that can be more quickly deployed from the top of a bridge deck. Accordingly, there is provided apparatus for providing access to the underside of a bridge deck comprising:

a support means positionable on said bridge deck;

a first cantilever support means mountable on said support;

a tower engageable with said first cantilever support means so as to allow said tower to be moved relative thereto whilst being supported substantially horizontally and so as to be rotatable into a substantially vertical position adjacent the bridge-deck;

a second cantilever support means mountable on said tower; and a platform engageable with said second cantilever support means so as to supported substantially perpendicularly to said tower underneath said bridge deck.

An apparatus according to the invention is hereinafter referred to as an under-bridge access assembly.

When deployed, the first cantilever support means supports the tower vertically down the side of the bridge-deck with the platform in turn supported horizontally beneath the bridge-deck by the second cantilever means mounted on the tower. Access is gained to the underside of the bridge deck by climbing down the tower and onto and along the platform.

The platform may conveniently be engaged with the second cantilever support means before the tower is launched over the side of the bridge-deck by being moved relative to the first cantilever support means. When the tower has been advanced sufficiently far it may then be rotated into a substantially vertical position adjacent the side of the bridge-deck at the same time bringing the platform into position beneath the bridge-deck. Alternatively the platform may be engaged with the second cantilever support means after the tower has been rotated to its vertical position by, for example, lowering the platform down to personnel who have climbed down the tower.

Preferably the platform is engageable with the second cantilever support means so as to allow the platform to be moved relative thereto whilst being supported substantially horizontally so that the horizontal position of the platform relative to the tower can be varied. If, for example, stores need to be lowered to the personnel on the platform, the platform can be adjusted so that a portion extends from the tower in a direction away from the underside of the bridge-deck to receive those stores.

More preferably the second cantilever support means is rotatably mounted on the tower so that the platform, when engaged with the second cantilever means, can be moved to first and second positions, respectively substantially parallel to and substantially perpendicular to the tower, there being provided locking means to lock the second cantilever support means in these two positions. With this arrangement the tower may be engaged with the first cantilever support means with the second cantilever support means locked in the first position. The platform may then be engaged with the second cantilever support means and moved relative to it whilst being suported thereby launching the platform over the side of the bridge-deck. The second cantilever support means may then be unlocked from the first position and rotated to, and locked in, the second position thus bringing the platform substantially perpendicular to the tower. The tower may then be launched and rotated, as described above, to deploy the platform beneath the bridge-deck. This method of engaging the platform perpendicular to the tower is particularly advantageous if a long platform is to be used.

The first cantilever support means may conveniently be fixed relative to the support means during deployment and retrieval of the underbridge access assembly, the tower being rotatable from a horizontal position to a vertical position by means of a pivot frame, engageable with first cantilever support means and rotatably attachable to the tower.

Both the platform and the tower may conveniently comprise a series of modules inter-engageable end to end so that each module may be jointed in turn to the proceeding one as it is fed into the first or second cantilever support means. Various length modules may conveniently be provided to allow the length of the platform and tower to be matched to the dimensions of the particular bridge to be demolished.

The modules are conveniently of an open truss construction and of trapezoidal cross section so that they are light and can be stacked within each other for compact transportation.

The support means may conveniently be a support pillar so as to provide a compact means of maintaining the first cantilever support means in the appropriate position on the bridge deck during deployment. The support pillar may be provided with a removable counterweight base beam having a ramp arranged so that a vehicle parked with its wheels on the ramp will stabilise the support pillar during deployment of the underbridge access assembly. This permits deployment without damaging the bridge which is particularly important for use of the assembly during peacetime training. If a flat decked vehicle is used to transport the modules, its deck can be used for construction of a platform and tower whilst simultaneously stabilising the support pillar.

If a single under bridge access assembly is deployed, the end of the platform furthest from the second cantilever support means should be supported beneath the bridge for added security—conveniently by a cable attached to the bridge parapet furthest from the support tower. Alternatively, if a bridge deck has to be spanned that has a greater width than the maximum length of the platform, two underbridge access assemblies may be deployed, one from each bridge parapet, and the two free ends of the platforms joined together by a linking module.

BRIEF DESCRIPTION OF DRAWINGS

An embodiment of the invention and a method of deployment thereof will now be described by way of example only with reference to the accompanying drawings of which

In FIG. 1 there is shown an under-bridge access assembly 2 fully deployed on a bridge deck 4 having a cambered road surface 6, a first and a second pedestrian way 8 and 10, and two parapets 12 14, and an under-bridge deck 16.

Referring to FIGS. 1 and 2 there is shown a launch frame 20, constituting the first cantilever support means, supported in position beside the parapet 12 by a support pillar 22 having a base 24 which rests on the pedestrian way 8 close to the parapet 12. The support pillar 22 is stabilised in a plane parallel to the plane of the parapet 12 by means of a pair of adjustable levelling struts 26 extending horizontally from the support pillar 22 which struts each have at their extremity a pad 28 fixed to a height-adjustable jack 30.

Figure 2:
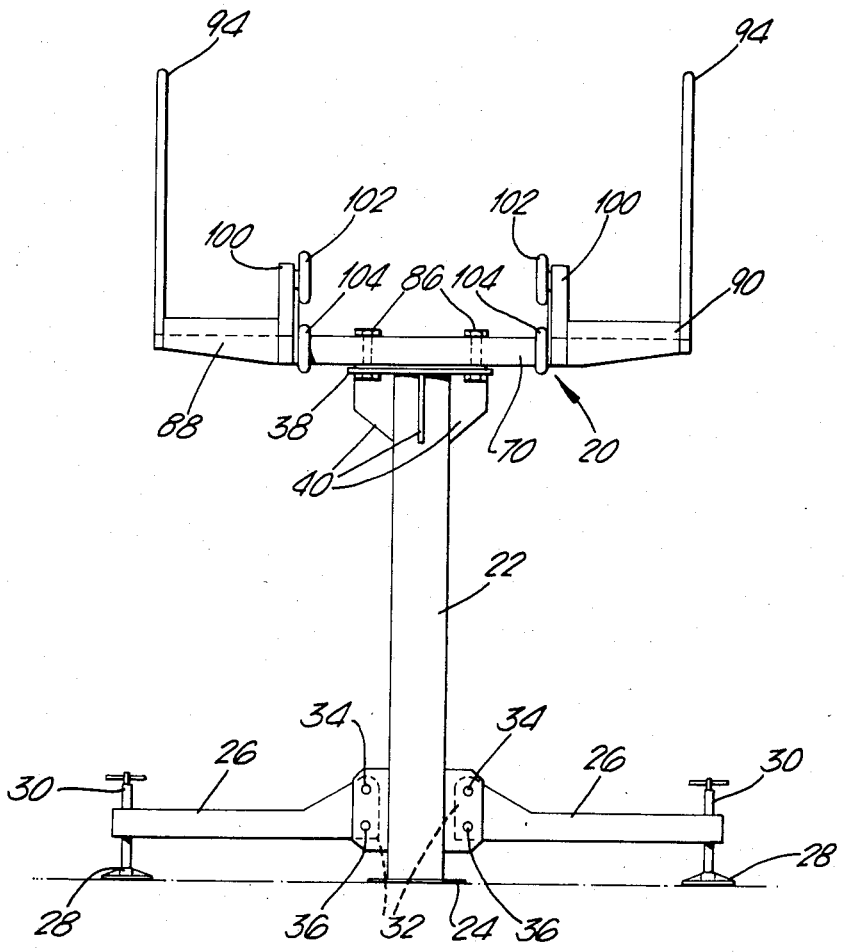
FIG. 2 is an end elevation view of the first cantilever support means and the support pillar of FIG. 1.

The levelling struts 26 are pivotally attached to fixing plates 32 attached near the base 24 of the support pillar 22 at pivot joints 34 so that the struts 26 can be made to lie next to the support pillar 22 for easier transportation. The struts 26 are fixed in the extended position as shown in FIG. 2 by fixing pins 36.

The support pillar 22 is capped by a horizontal aluminium plate 38 which is fixed in position by welded joints to four vertical support plates 40 equidistantly spaced around the support pillar 22.

Figure 3:
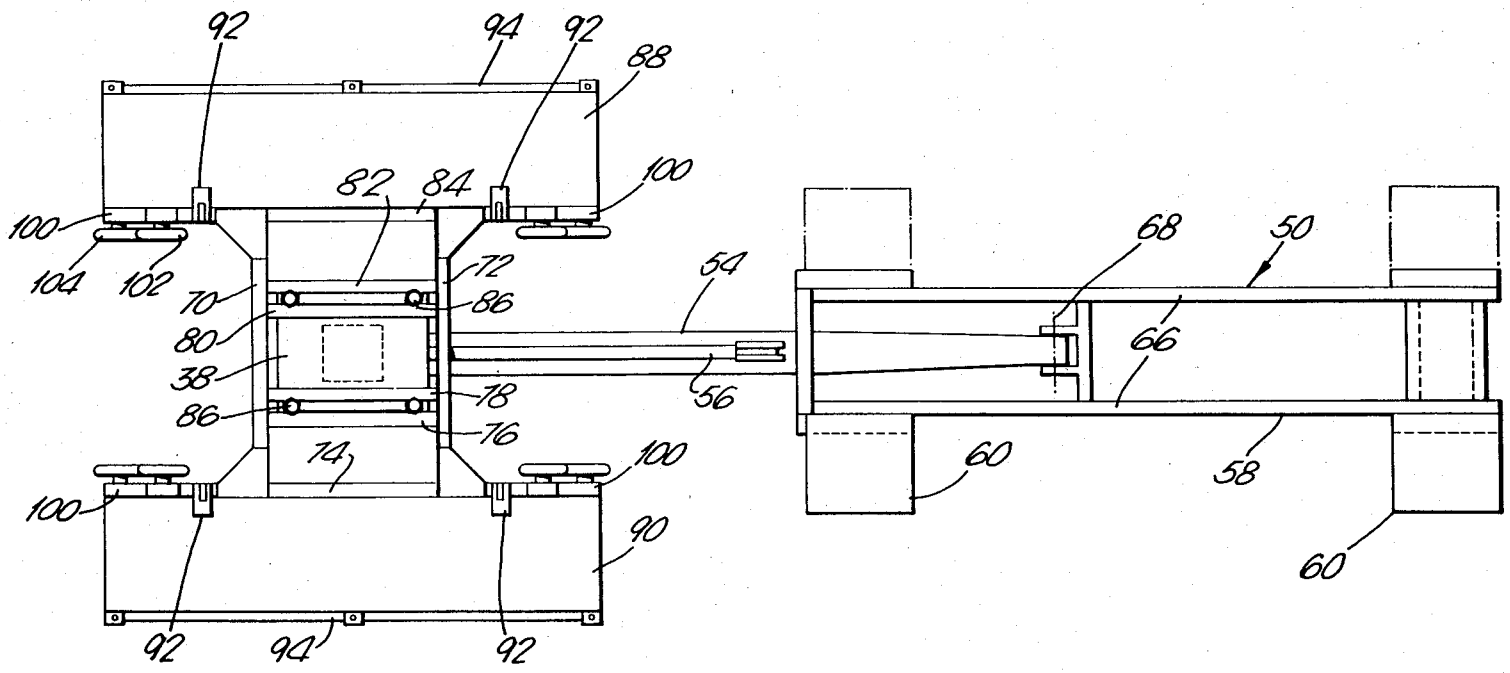
FIG. 3 is a plan view of the cantilever support means shown in FIG. 2 together with a counterbalance arm arrangement.
Figure 5:
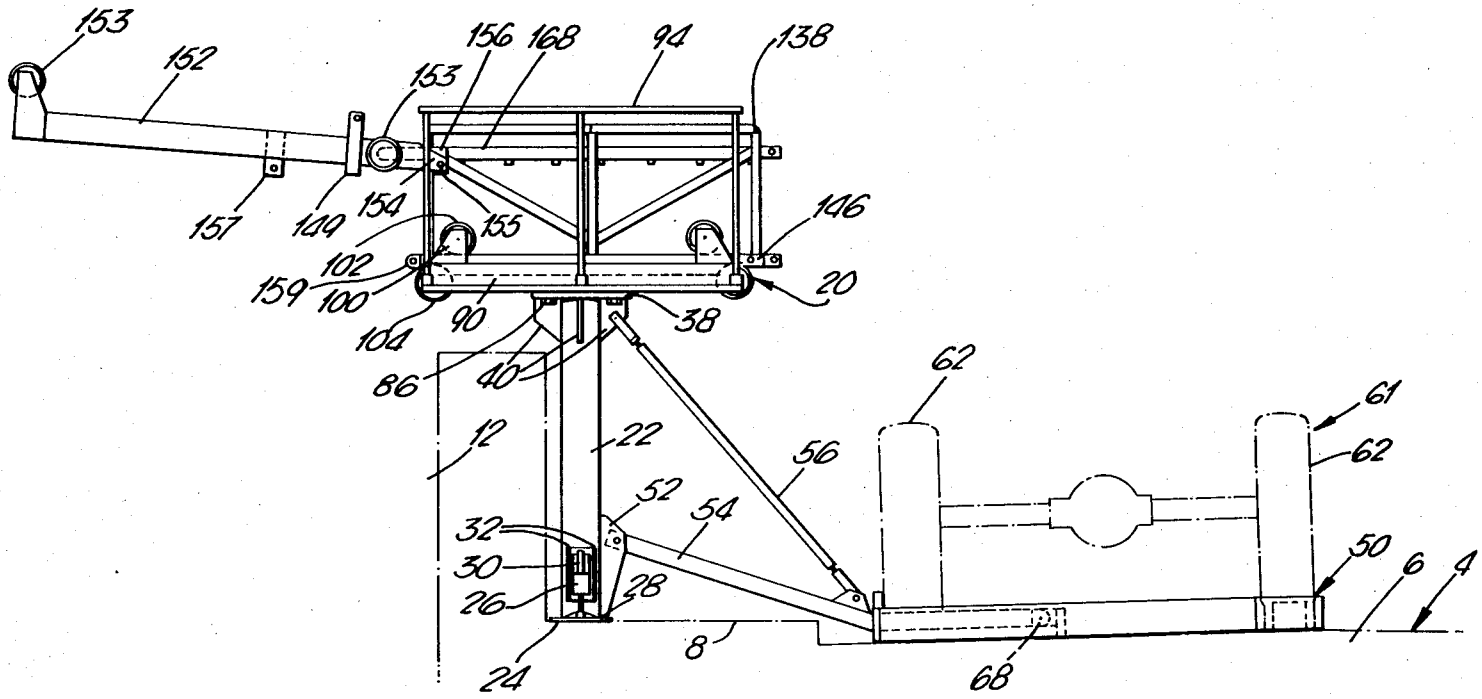
FIG. 5 is a side elevation view of the first cantilever support means and the support pillar of FIG. 1 with a tower module engaged with the first cantilever support means on which is mounted the second cantilever support means fixed in a generally horizontal position to receive the platform modules.
Figure 6:
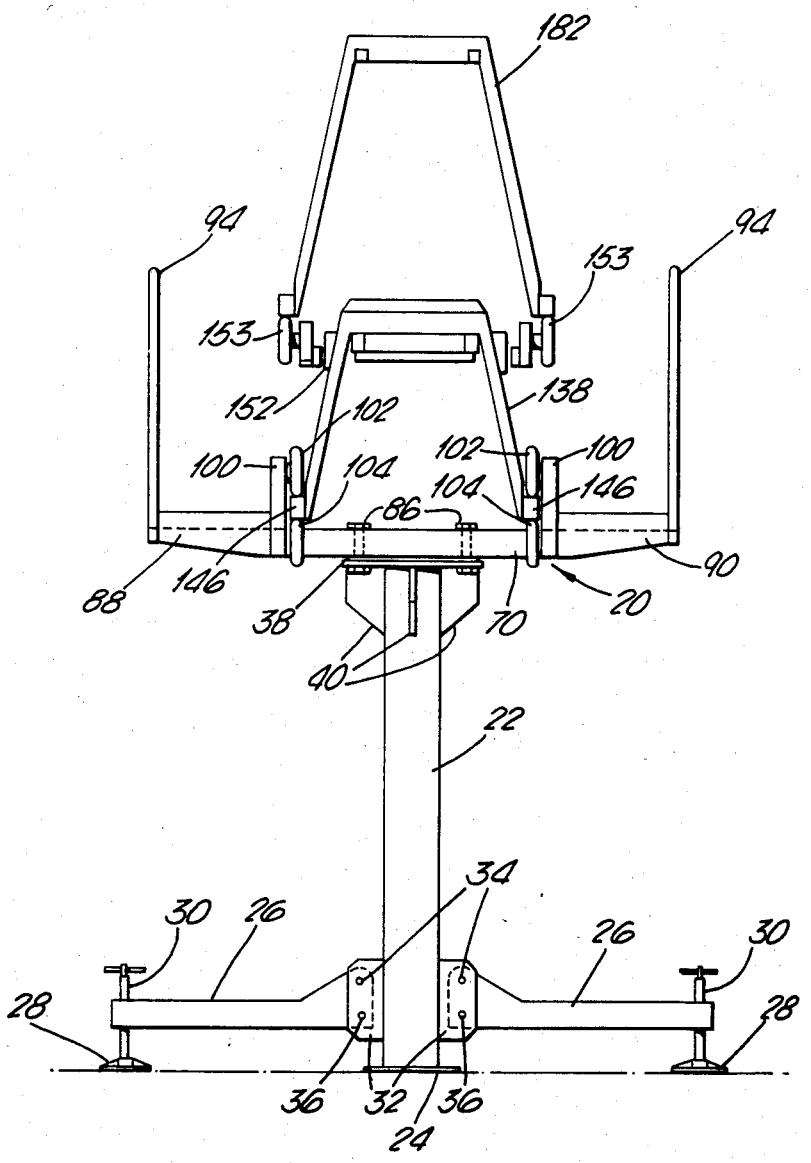
FIG. 6 is an end elevation view of the arrangement of FIG. 5 with a platform module in engagement with the second cantilever support means.

The support pillar 22 is provided with stability in the vertical plane perpendicular to the plane of the parapet 12 during deployment of the under-bridge access assembly by means of a counterweight base beam 50 connected to a vertical plate 52 welded near the base of the support pillar 22 by a fixed length connecting arm 54. The support pillar 22 is maintained in a vertical position by means of a strut 56 pivotally attached to one of the plates 40 at the top of the support pillar 22 and to the connecting arm 54 which is pivotally attached to the counterweight base beam 50 at a pivot joint 68 (as shown in FIGS. 3 and 5). This arrangement permits the counterweight base beam to be used on different bridge decks having different height relationships between the pedestrian way and the roadway.

Referring to FIG. 3 the counterweight base beam 50 comprises an open, rectangular framework 58 having four ramps 60 each hinged to the framework 58 so that they can be folded for ease of transportation. A lorry 61 (FIG. 1) can be driven up the ramps 60 so that a pair of its wheels 62 are positioned between side members 66 of the framwork 58 (see FIG. 1). The weight of the lorry 61 provides stability to the support pillar 22 during deployment of the under bridge access assembly 2. The support pillar 22 and counterweight base beam 50 constitute the support means for the access assembly 2.

Figure 1:
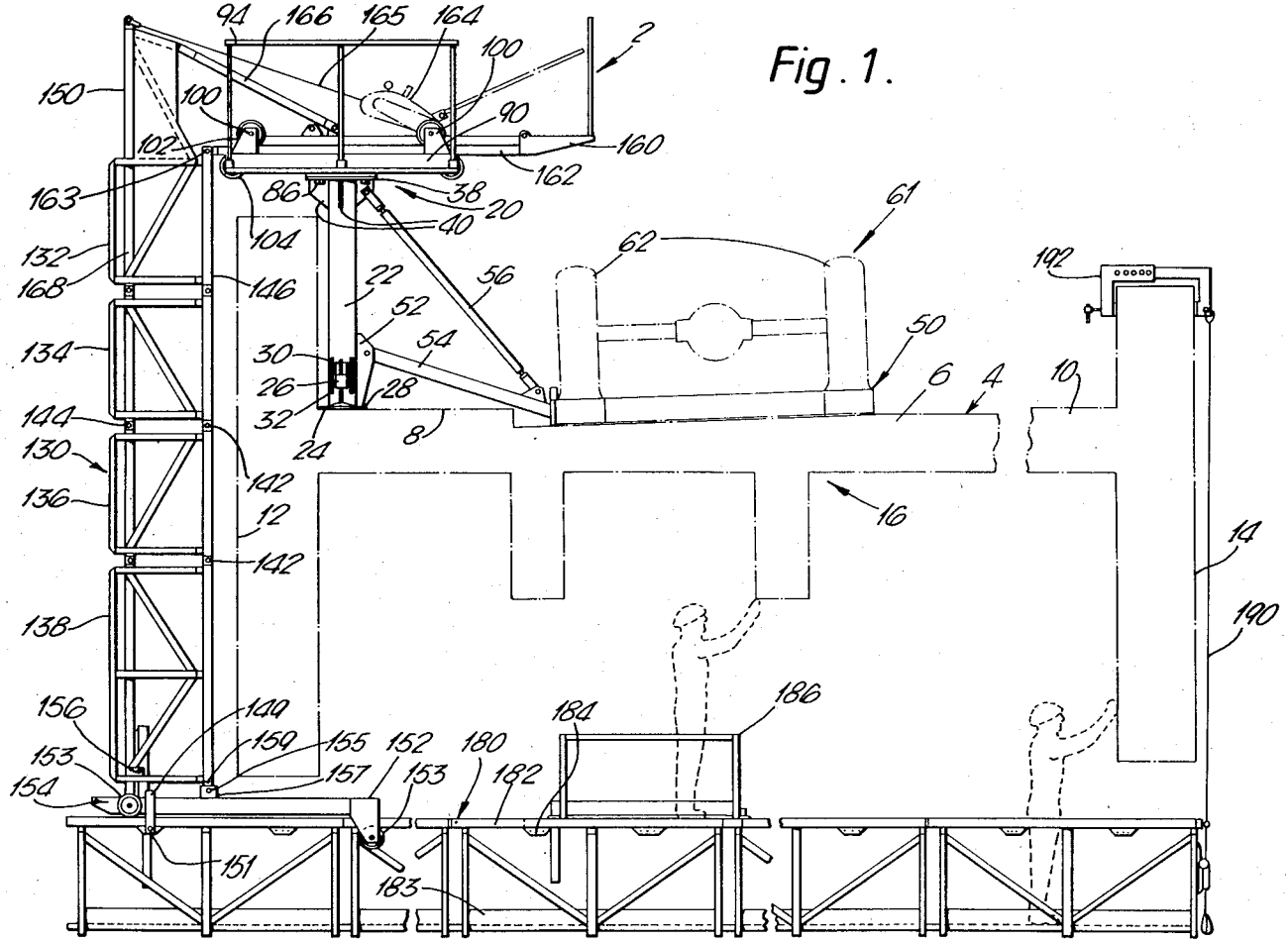
FIG. 1 shows a side elevation view of an under-bridge access assembly fully deployed from a bridge deck shown in cross-section.

Referring now to FIGS. 1, 2 and 3 the launch frame 20 has two main spars 70 and 72 joined by six cross-beams 74, 76, 78, 80, 82 and 84. The cross-beam pairs 76, 78 and 80, 82 are closely spaced and positioned so that four fixing bolts 86 can pass between the cross beam pairs to be located in fixing holes in the plate 38 thereby locating the launch frame 20 in position on the top of the support pillar 22.

Two work platforms 88 and 90 are each hinged to the ends of the main spars 70 and 72 at hinged joints 92, each platform being provided with an outer safety rail 94.

The ends of the main spars 70 and 72 terminate in perpendicular end plates 100 on which are located pairs of upper and lower rollers 102 and 104 which constitute the first cantilever support means.

Figure 4:
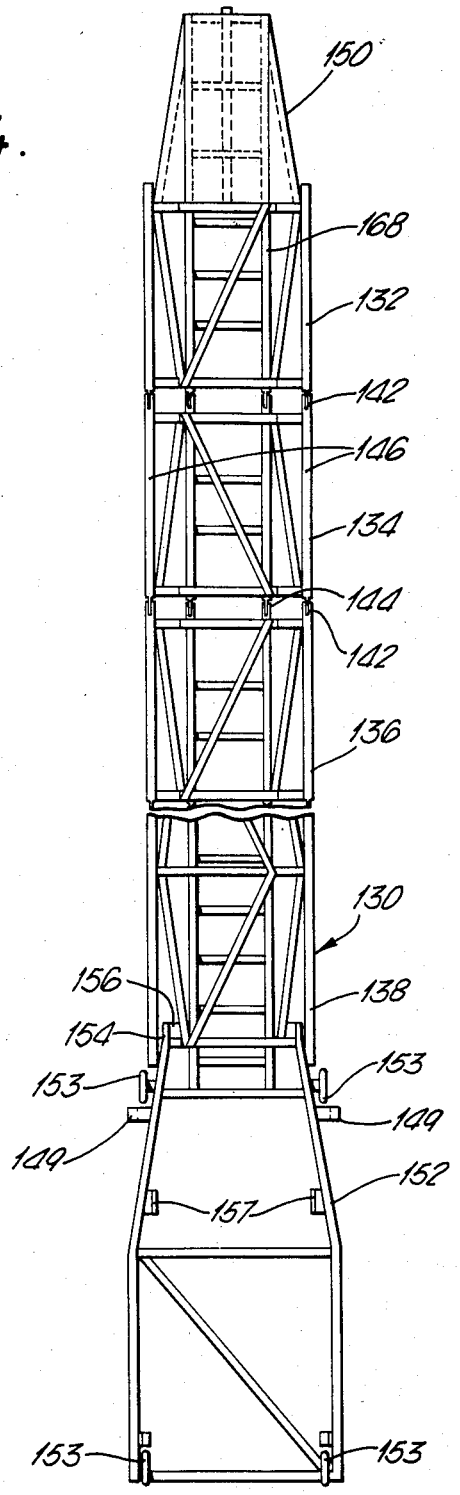
FIG. 4 is a plan view of the tower of FIG. 1 before deployment.

Referring now to FIG. 4 there is shown a tower 130 as used in the under-bridge access assembly of FIG. 1 consisting of tower modules 132, 134, 136 and 138 connected end to end by pairs of hook joints 142 and pin joints 144. The tower modules 132 to 138 are of open truss construction each having two parallel roller engagement flanges 146, all having a trapezoidal cross section to allow them to be nested for transportation. The tower module 132 is fitted with an open frame 150. Pivotally attached to the end tower module 138 is a cantilever frame 152 having two pairs of rollers 153, constituting the second cantilever support means, which can be locked perpendicular to the tower 130 by a pair of locking pins 155 linking pairs of flanges 157 and 159 or substantially parallel to it by the pins 155 linking pairs of flanges 154 and 156, as shown in FIGS. 1 and 5, respectively.

Referring to FIG. 1, the tower module 132 is pivotally attached to a pivot frame 160, constituting a connecting means, by means of pins 163, the frame 160 having side spars 162 engaged with the rollers 102 and 104 of the launch frame 20. A hand operated winch 164 with cable 165 attached to the pivot frame 160 and the frame 150 can be used to rotate the tower during deployment and retrieval.

In FIG. 1 the tower 130 is shown in its deployed, vertical position where it is maintained by a pair of bracing struts 166 fixed between the frame 150 of the tower 130 and the pivot frame 160.

The tower modules 132 to 138 are each provided with a ladder section 168 (see FIG. 4) so that when the tower 130 is in its deployed position personnel can climb down inside the tower 130 from the bridge deck 4.

A platform 180, comprising a plurality of platform modules 182 connected end to end by hook and pin joints in the same manner as the tower modules are interconnected, is supported by the cantilever frame 152. The platform modules 182 are of open truss construction and of trapezoidal cross section to allow them to be nested within one another for compactness during transportation. They are provided with decking 183 to permit personnel to walk along the platform 180 when it is deployed. Each platform module 182 is provided with drilled plates 184 to which a safety harness can be attached. An auxiliary staging unit 186 mounted on top of the platform 180 provides access when required above the reaching height of personnel on the platform 180. The decking 183 of the platform 180 is provided with spaced-apart holes to locate the bottom of a ladder (not shown) if needed to reach above the access level provided by the unit 186.

The platform 180 as shown in FIG. 1 has been advanced through the cantilever frame 152 until the end of the platform 180 furthest from the cantilever 152 is close to the parapet 14 on the far side of the bridge. When in this position the weight of the platform acts to rotate the assembly 2 in a clockwise direction as viewed in FIG. 1. A clamp 192 fixed to the parapet 14 supports a simple cable and pulley arrangement 190 which is attached to the end of the platform 180 to support the weight of the platform 180. Once the platform has been secured to the parapet 14 in this manner, the counterweight base beam 50, the connector 54 and the strut 56 can be removed to permit traffic to fully utilise the roadway 6.

The under-bridge access assembly as described above with reference to FIGS. 1 to 6 is deployed as follows.

Firstly the support tower 22 is unloaded from the lorry 61 and erected by deploying the struts 26 and adjusting the height of the jacks 30. The counterweight base beam 50 is then unloaded and connected to the base of the support tower by means of the connector 54. The lorry 61 is backed onto the counterweight base beam 50 and the strut 56 adjusted to maintain the support tower 22 in a vertical position. The launch frame 20 is now placed on top of the support tower 22 and bolted into position, the work platforms 88 and 90 folded down into position and the safety rails 94 fixed into place. The end tower module 138 with the attached cantilever frame 152 is then engaged with launch frame 20.

The platform modules 182 are added one at a time by linking each one to the last platform module supported by the cantilever frame 152 and subsequently advancing the platform modules through the rollers 153 thereby cantilevering out the rest of the platform 182. Once a sufficient number of platform modules 182 have been launched to span the underside of the bridge from directly below the parapet 12 the platform is locked into position relative to the frame 152 by means of simple pins 151 through flanges 149 fixed to the frame 152 and the drilled plates 184 of the platform module after which the cantilever frame 152 is rotated through a little more than 90° thereby bringing the platform into a vertical position down the side of the parapet 12 where it is fixed in position by the pins 155.

Further tower modules 132 to 136 may now be linked in sequence to the tower module 138 and cantilevered-out from the launch frame 20 in a similar manner to the way in which the platform 180 was cantilevered-out from the cantilever frame 152. The final tower module 132 with the frame 150 is connected when it together with the modules that have already been launched covers the distance between the launch frame 20 and the bottom of the parapet 12. The pivot frame 160 is then pivotally linked to the tower module 132 by the pivot pins 163 and maintained in alignment with the pivot frame 160 by means of the hand winch 164 linking the pivot frame 20 to the frame 150 of the tower module 132. The tower 130 is then advanced through the launch frame 20 until the pivot frame 160 is engaged with the rollers 102 and 104 of the launch frame 20 and the pivot pins 163 overhang the parapet 12. The tower 130 may now be pivoted into a vertical position by letting out the cable 165 from the winch 164.

When the tower 130 is in a vertical position it is secured in position by means of the pair of bracing struts 166. The platform 180 is now positioned horizontally and parallel to the underside 16 of the bridge deck. The clamp 192 is then clamped to the parapet wall 14 on the other side of the bridge deck from the support tower 22 and the support cable arrangement 190 attached to the free end of the platform 180. The winch assembly 164 is now removed as are the lorry 61 and the counterweight base beam 50 thereby freeing access to the roadway 6. If it is necessary to span a bridge of larger width than can be accommodated by a single under-bridge access assembly as described above it is possible to launch one from each side of the bridge deck, joining the free ends of each platform 180 by climbing down the ladder rungs 168 fixed in the tower 130. The platform 180 can be positioned so that part of its extends from the tower in the direction away from the parapet 12. This provides a platform on to which stores can be lowered from a pulley (not shown) attached to the top of the tower module 132.

In some operations it may be necessary for the vehicle on which the component parts of an under-bridge access assembly according to the present invention were transported to a bridge to depart before the under-bridge access assembly is deployed. In this case the vehicle will not be available to stabilise the support tower by placing its wheels on the counterweight base beam 50 which may alternatively be held down to the bridge by bolts (not shown) fired into the bridge deck 4 from a bolt gun.

The platform 180 may be provided with side netting in order to prevent the loss of stores from the platform 180.

What is claimed is:

1. Apparatus for providing access to the underside of a bridge deck comprising:

(i) a support means positionable on said bridge deck:

(ii) a first cantilever support means mountable on said support means;

(iii) a plurality of tower modules separate from each other but selectively interengageable end to end such that they can be assembled to form a tower, and including a first tower module on which is rotatably mounted a second cantilever support means, each of said tower modules being separately engageable with said first cantilever support means so as to be advanceable therethrough whilst being supported thereby substantially horizontally such that a further tower module is engageable with a previous tower module supported by said first cantilever means and is advanceable into engagement with said first cantilever means to advance the previous tower module therethrough so that the further tower module is then supported by the first cantilever means and supports the previous tower modules which have been assembled and advanced through said first cantilever means; and (iv) a plurality of platform modules separate from each other but selectively interengageable end to end such that they can be assembled to form a platform, each of said platform modules being separately engageable with said second cantilever support means when said first tower module is supported by said first cantilever support means such that each of said platform modules is advanceable through said second cantilever support means whilst being supported thereby substantially horizontally such that a further platform module is engageable with a previous platform module supported by said second cantilever means and the further platform module is advanceable into engagement with said second cantilever means to advance the previous platform module therethrough so that the further platform module is then supported by the second cantilever means and supports previous platform modules which have been assembled and advanced through said second cantilever means; and in which (v) said tower is supportable by said first cantilever support means both substantially horizontally and substantially vertically; and (vi) said platform is supportable by said second cantilever support means both substantially parallel to and substantially perpendicular to said tower.

2. Apparatus as claimed in claim 1 in which said support means includes a detachable counterbalance means adapted to support a wheel of a vehicle thereby to maintain said support means in position on said bridge deck during deployment of said apparatus.

3. Apparatus as claimed in claim 1 in which there is included a platform support means connectable between the bridge deck and the end of said platform remote from said tower thereby supporting said end of said platform.

4. Apparatus as claimed in claim 1 including a connecting means engageable end to end with one of said tower modules so as to be rotatable relative thereto and engageable with said first cantilever support means, and including a rotating means connected between said connecting means and said one of said tower modules whereby said tower is rotatable relative to said connecting means to rotate said tower from said substantially horizontal position to said substantially vertical position.

5. A method of providing access to the underside of a bridge deck using apparatus comprising:

(i) a support means positionable on said bridge deck;

(ii) a first cantilever support means mountable on said support means;

(iii) a plurality of tower modules interengageable end to end to form a tower, and including a first tower module on which is rotatably mounted a second cantilever support means, each of said tower modules being engageable with said first cantilever support means so as to be advanceable therethrough whilst being supported substantially horizontally; and (iv) a plurality of platform modules interengageable end to end to form a platform, each of said platform modules being engageable with said second cantilever support means so as to be advanceable therethrough whilst being supported substantially horizontally; and in which (v) said tower is supportable by said first cantilever support means both substantially horizontally and substantially vertically; and (vi) said platform is supportable by said second cantilever support means both substantially parallel to and substantially perpendicular to said tower, said method comprising the steps of a. positioning said support means on said bridge-deck;

b. mounting said first cantilever support means on said support means;

c. mounting said second cantilever support means on a first tower module of said tower modules;

d. engaging the said first tower module with said first cantilever means;

e. engaging a first platform module of said platform modules with said second cantilever means;

f. inter-engaging end to end a further platform module with the platform module last engaged with said second cantilever means and advancing the platform therethrough;

g. repeating step f thereby launching the platform substantially parallel to said first tower module substantially horizontally over the side of said bridge deck until the platform is of predetermined length;

h. rotating said platform to said position substantially perpendicular to said first tower module;

i. inter-engaging a further tower module with the tower module last engaged with said first cantilever support means and advancing said tower therethrough;

j. repeating step i thereby launching the tower substantially horizontally over the side of said bridge-deck until the tower is of predetermined length;

k. rotating said tower from said substantially horizontal position to said substantially vertical position.

* * * * *